United States Patent [19]

Baffert et al.

[11] 4,301,008

[45] Nov. 17, 1981

[54] SKIMMER FOR REMOVING THE SURFACE LAYER FROM A STRETCH OF LIQUID

[75] Inventors: Alain Baffert, Grenoble; Michel Fauconnet, Saint Egreve; Christian Gales, Domene; Claude Roig, Grenoble, all of France

[73] Assignee: Alsthom-Atlantique, Paris, France

[21] Appl. No.: 134,002

[22] Filed: Mar. 26, 1980

[30] Foreign Application Priority Data

Mar. 30, 1979 [FR] France ..... 79 08037

[51] Int. Cl.[3] ..... E02B 15/04

[52] U.S. Cl. ..... 210/242.3; 210/923

[58] Field of Search ..... 210/242.1, 242.3, 923, 210/800

[56] References Cited

U.S. PATENT DOCUMENTS

| | | | |
|---|---|---|---|
| 2,961,098 | 11/1960 | Nash | 210/241 |
| 3,762,557 | 10/1973 | Tudor et al. | 210/242 S |
| 3,782,553 | 1/1974 | Brekke | 210/242 |
| 4,024,063 | 5/1977 | Mori | 210/242 R |

FOREIGN PATENT DOCUMENTS

| | | |
|---|---|---|
| 2238360 | 2/1975 | France . |
| 2358514 | 2/1978 | France . |
| 425647 | 6/1967 | Switzerland . |

*Primary Examiner*—Thomas G. Wyse

*Attorney, Agent, or Firm*—Sughrue, Mion, Zinn, Macpeak and Seas

[57] ABSTRACT

A skimmer comprising two main, nested components: a skim vat (1) supported by floats (3) and arranged to float beneath the surface (5) of a sheet of liquid; and a spillway (6) supported by floats (7) and free to move telescopically with respect to the skim vat. Liquid is extracted from the bottom of the skim vat (1), thereby lowering the surface (8) of the liquid therein until the spillway (6) which floats with respect to the inside liquid surface (8) has moved far enough down for the rate of flow of surface liquid into the skimmer over the rim of the spillway, to match the rate of extraction via the pipe (4). Two O-ring seals (9 and 11) prevent liquid from escaping from the inside of the skimmer while allowing the nested components to move relative to each other. The skimmer is particularly intended for removing surface pollution from stretches of water.

1 Claim, 1 Drawing Figure

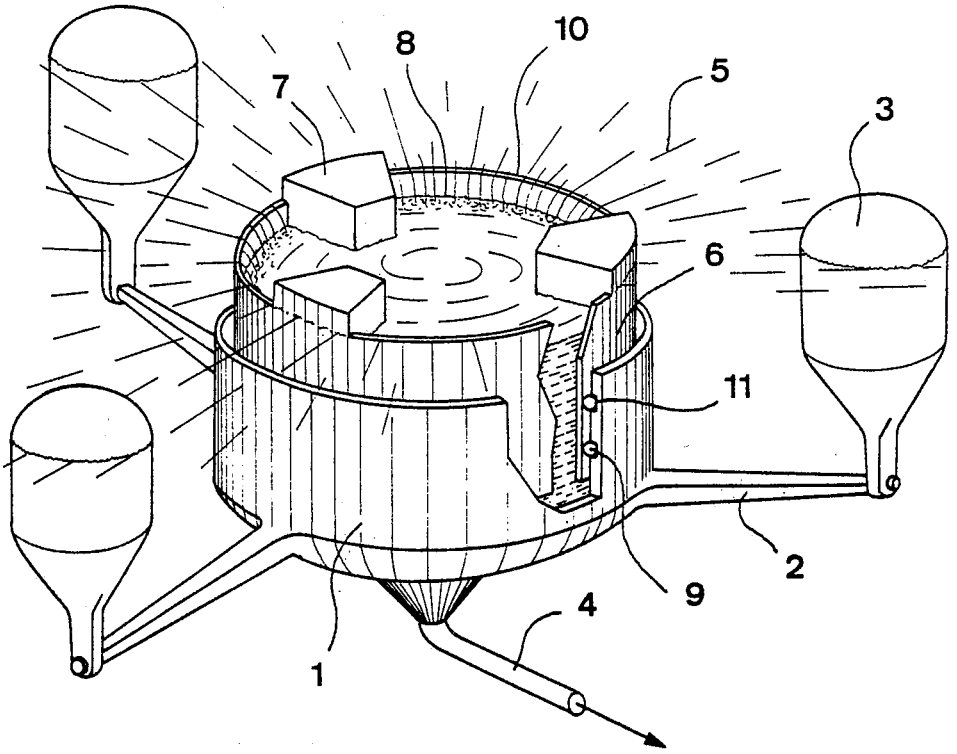
10
8
7
5
3
6
11
2
9
4
1

SKIMMER FOR REMOVING THE SURFACE LAYER FROM A STRETCH OF LIQUID

FIELD OF THE INVENTION

The invention relates to floating apparatus capable of collecting the surface layer from a sheet of liquid.

BACKGROUND OF THE INVENTION

Such a surface layer may be constituted by another liquid such as a hydrocarbon spill on a stretch of water, for example, or it may be constituted by floating solid particles such as dust, leaves or foam, for example. Examples of the sheet of liquid include a sheet of water which may or may not be confined such as a dock, a river, a lake or even the sea.

Known skimmers include a surface layer spillway which floats above a skim vat from which the decanted substance is removed. Generally, sealing is provided between the skim vat and both the spillway and the body of liquid in which they are immersed by a bellows or a flexible membrane connecting the two members together while permitting the spillway to move relative to the vat as a function of fluctuations in level inside the vat and in the liquid in which they are immersed.

Such a sealing arrangement has the disadvantage that its size needs to be specially adapted to the sizes of the spillway and the vat. Further, the material from which the seal is made is not necessarily compatible with the chemical aggressiveness of the medium in which it is immersed.

Preferred embodiments of the invention provide a skimmer whose seal is easy to realize using means which are readily adaptable to the size of the vat, and made of material capable of withstanding the aggressiveness of the medium with which it is required to come into contact.

SUMMARY OF THE INVENTION

The invention provides a skimmer for removing the surface layer from a stretch of liquid, the skimmer comprising a skim vat with a surface layer spillway floating thereabove, with the spillway and the vat slidably nested one in the other, wherein sealing between these two members being provided by at least one sliding seal which is fast with one of the members and slidable over the other.

The seal may be constituted by an O-ring.

The skim vat may be provided with means to make it float in the liquid.

An embodiment of the invention is described by way of example with reference to the sole FIGURE of the accompanying drawing which is a partially cut-away schematic perspective view of a skimmer in accordance with the invention.

DESCRIPTION OF THE PREFERRED EMBODIMENT

In the FIGURE, the skimmer is constituted by a an upwardly open, closed bottom, cylindrical skim vat 1 supported by floats 3 via arms 2. The bottom of the vat 1 is connected via a pipe 4 to a storage tank (not shown). The skimmed substances are transferred by pumping or simply by gravity.

A cylindrical spillway 6 provided with floats 7 is nested inside the vat 1. In between the vertical walls of the upper end of the vat 1 and the lower end of the spillway 6 there are two O-ring seals 9 fitted in grooves 11 in the inner wall of the vat 1 and disposed with some play against the outer walls of the cylindrical spillway 6, allowing the spillway to slide against the seals 9. Spillway 6 is open at its bottom and top.

The skimmer operates as follows. The vat 1 and its spillway 6 are immersed in a sheet of liquid having a level 5. The floats 3 are adjusted so that the vat 1 floats below the surface layer of the liquid, which then flows into the vat 1 forming a spill wave 10 over the rim of the spillway 6 whose level determines the flow rate. The spill wave 10 principally entrains the surface layer of the liquid i.e. any floating substances. The liquid which fills the vat 1 is removed via the pipe 4 thereby lowering the liquid level 8 inside the apparatus and consequently lowering the spillway 6 which is floating on the level 8. Indeed, the seals make it possible for the vertical wall of the spillway 6 to slide vertically while maintaining suitable sealing between the inside of the vat and the body of liquid which surrounds it.

Such a device can use conventional seals which already exist in many sizes. Such seals are therefore easy to replace and to obtain in a material appropriate to the medium in which they are to operate.

We claim:

1. A skimmer for removing the surface layer from a stretch of liquid, said skimmer comprising an upwardly open cylindrical skim vat member with a surface layer open ended cylindrical spillway member floating therabove, said spillway member and said vat member being slidably nested one within the other, at least one sliding seal (9) fast with one of said members and slidable over the surface of the other member and defining a seal between said nested members, and wherein said sliding seal comprises an O-ring seal.

* * * * *